US005107277A

United States Patent [19]

Mori

[11] Patent Number: 5,107,277

[45] Date of Patent: Apr. 21, 1992

[54] CURRENT SENSITIZED TRANSFER TYPE PRINTER WITH A HEATED COMMON ELECTRODE

[75] Inventor: Takashi Mori, Tokyo, Japan

[73] Assignee: Ricoh Company, Ltd., Tokyo, Japan

[21] Appl. No.: 673,279

[22] Filed: Mar. 21, 1991

[51] Int. Cl.[5] ..... B41J 2/39; B41J 2/395

[52] U.S. Cl. ..... 346/76 PH; 346/139 C; 400/120

[58] Field of Search ..... 346/76 PH, 139 C; 400/120, 120 SR, 121, 124

[56] References Cited

FOREIGN PATENT DOCUMENTS 0184866 8/1987 Japan ..... 346/76 PH 63-7952 1/1988 Japan .

OTHER PUBLICATIONS

Wilbur, "Thermal Biasing Technique for Electrothermic Printing", IBM Disclosure Bulletin, vol. 23, No. 9, Feb. 1981.

*Primary Examiner*—Benjamin R. Fuller

*Assistant Examiner*—Huan Tran

*Attorney, Agent, or Firm*—Cooper & Dunham

[57] ABSTRACT

A current-sensitized transfer type printer comprising an ink sheet including an ink layer, a conductive layer and a resistance layer which are stacked in this order, a feeding mechanism for feeding the ink sheet in a predetermined direction, a plurality of recording electrodes, each of which is in contact with the resistance layer of the ink sheet, a common electrode which is in contact with the resistance layer of the ink sheet, a power supply for supplying a current between each recording electrode which is selected in accordance with image information and the common electrode, the current flowing through the resistance layer and the conductive layer existing between each recording electrode which is selected and the common electrode, and a heater for heating the common electrode.

4 Claims, 4 Drawing Sheets

CURRENT SENSITIZED TRANSFER TYPE PRINTER WITH A HEATED COMMON ELECTRODE

BACKGROUND OF THE PRESENT INVENTION

The present invention generally relates to a current-sensitized transfer type printer, and particularly to a current-sensitized transfer type printer in which voltage is supplied to a resistance layer of an ink sheet, which has a resistance layer, a conductive layer and an ink layer, so that a fused ink is transferred to a recording sheet.

A current-sensitized transfer type printer is disclosed in Japanese Pat. Laid Open Publication No. 63-7952. This conventional current-sensitized transfer type printer is, for example, shown in FIG.1. Referring to FIG.1, the current-sensitized transfer type printer has an ink sheet 1. The ink sheet 1 comprises an ink layer 2, a conductive layer 3 and a resistance layer 4, which are stacked in this order. When a printing process for forming an image on a recording sheet 10 is carried out, the ink layer 2 is maintained in a condition in which the ink layer 2 is in contact with a recording sheet 10. A plurality of recording electrodes 5 and a common electrode 6 are respectively in contact with the resistance layer 4 of the ink sheet 1.

One or a plurality of recording electrodes 5 are selected in accordance with a printing signal corresponding to image data, and then a voltage output from a power supply 7 is applied across each selected recording electrode 5 and the common electrode 6. When the voltage is applied across each recording electrode 5 which is selected in accordance with the printing signal and the common electrode 6, a current flows through a corresponding portion of the resistance layer 4, each selected recording electrode 5 being in contact with each corresponding portion. Thus, each of the corresponding portions of the resistance layer 4 through which the current flows generates heat, so that heated ink of the ink layer 2 is fused or sublimated and transferred to the recording sheet 10.

In general, the current-sensitized transfer type printer has the following disadvantage.

That is, when the number of the recording electrodes 5 which are selected in accordance with the printing signal changes from the number of the same previously selected, the amount of current which flows into each selected recording electrode 5 changes. Therefore, the density of each dot, in an image, formed by each corresponding recording electrode 5 changes in accordance with the printing signal.

The above disadvantage occurs due to the following two causes.

First, a contact resistance between the common electrode 6 and the resistance layer 4 of the ink sheet 1 changes in accordance with the number of the selected recording electrodes 5.

The resistance layer 4 generally has a rough surface, as shown in FIG.2, with which the common electrode 6 is in contact. Thus, in this state, the contact resistance between the resistance layer 4 and the common electrode 6 is relatively large. In a case where the number of the selected recording electrodes 5 is small, the amount of the current flowing through the resistance layer 4 is small. As a result, the state where the contact resistance between the resistance layer 4 and the common electrode 6 is large is maintained, so that the current flowing into each selected recording electrode 5 is small. On the other hand, in a case where the number of the selected recording electrodes 5 is large, the amount of the current flowing through the resistance layer 4 is large, so that the amount of heat generated by the resistance layer 4 increases and the resistance layer 4 is softened. As a result, an area where the resistance layer 4 and the common electrode 6 are in contact with each other increases, so that the contact resistance between the resistance layer 4 and the common electrode 6 decreases. When the contact resistance between the resistance layer 4 and the common electrode 6 decreases, the current flowing into each selected recording electrode 5 increases.

Second, a voltage, $V_R'$ supplied to each portion of the resistance layer 4, each portion being in contact with each corresponding selected recording electrode 5, greatly changes in accordance with the number of the selected recording electrodes 5.

An equivalent circuit substantially representing a system including the resistance layer 4, the recording electrodes 5, the common electrode 6 and the power supply 7 is illustrated in FIG.3. In FIG.3, R denotes the contact resistance between the resistance layer 4 and the common electrode 6. R denotes a resistance of each corresponding portion of the resistance layer 4, each selected recording electrode 5 being in is contact with each corresponding portion. The resistance layer 4 of the ink sheet 1 has the rough surface as shown in FIG.2, so that the contact resistance R between the resistance layer 4 and the common electrode 6 is relatively large. In a case where the contact resistance R is large as described above, when the number of the selected recording electrodes 5 changes from the number of the same previously selected and a combined resistance ($R'=r/n$ where n is the number of selected recording electrodes 5) of corresponding portions of the resistance layer 4, each corresponding portion having a resistance R, the drop voltage $V_R$ at the contact resistance R greatly changes. As a result, when the number of the selected recording electrodes 5 changes, a voltage $V_R'$ supplied to each corresponding portion of the resistance layer 4, each corresponding portion being in contact with each corresponding selected recording electrode 5 also greatly changes.

To eliminate the above disadvantage, in the conventional current-sensitized transfer type printer, the width of a current pulse supplied to each selected recording electrode 5 is controlled in accordance with the number of the selected recording electrodes 5. However, in this conventional current-sensitized transfer type printer, it is necessary to count the number of the recording electrodes 5 which the current should be supplied to. As a result, a circuit for supplying the current to the selected recording electrodes 5 becomes complex, and the cost for the circuit increases.

SUMMARY OF THE INVENTION

Accordingly, a general object of the present invention is to provide a novel and useful current-sensitized transfer type printer in which the disadvantage of the aforementioned prior art is eliminated.

A more specific object of the present invention is to provide a current-sensitized transfer type printer having a simple structure, and in which printer the variation of the current supplied to each selected recording electrode is small.

The above objects of the invention are achieved by a current-sensitized transfer type printer comprising: an ink sheet including an ink layer, a conductive layer and a resistance layer, which are stacked in this order; feeding means, coupled to the ink sheet, for feeding the ink sheet in a predetermined direction; a plurality of recording electrodes, each of which is in contact with the resistance layer of the ink sheet; a common electrode which is in contact with the resistance layer of the ink sheet; power supply means, provided between each recording electrode and the common electrode, for supplying a current between each recording electrode which is selected in accordance with image information and the common electrode, the current flowing through the resistance layer and the conductive layer existing between each recording electrode which is selected and the common electrode; and heater means, coupled to the common electrode, for heating the common electrode, whereby ink of the ink layer is heated by heat generated in the resistance layer and transferred to a recording sheet.

Additional objects, features and advantages of the present invention will become apparent from the following detailed description when read in conjunction with the accompanying drawings.

DESCRIPTION OF THE PREFERRED EMBODIMENTS

A description will now be give of an embodiment of the present invention with reference to the accompanying drawings.

Figure 1:
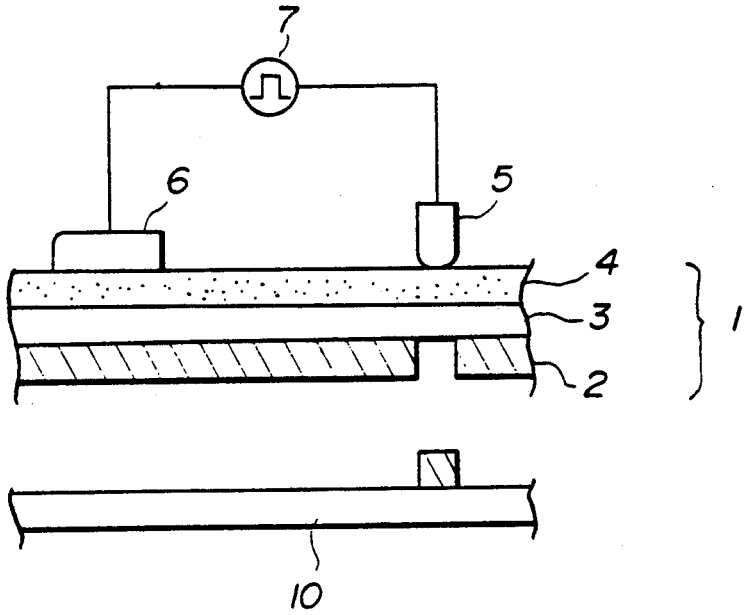
FIG. 1 PRIOR ART
FIG. 1 is a cross sectional view showing a conventional current-sensitized transfer type printer.
Figure 3:
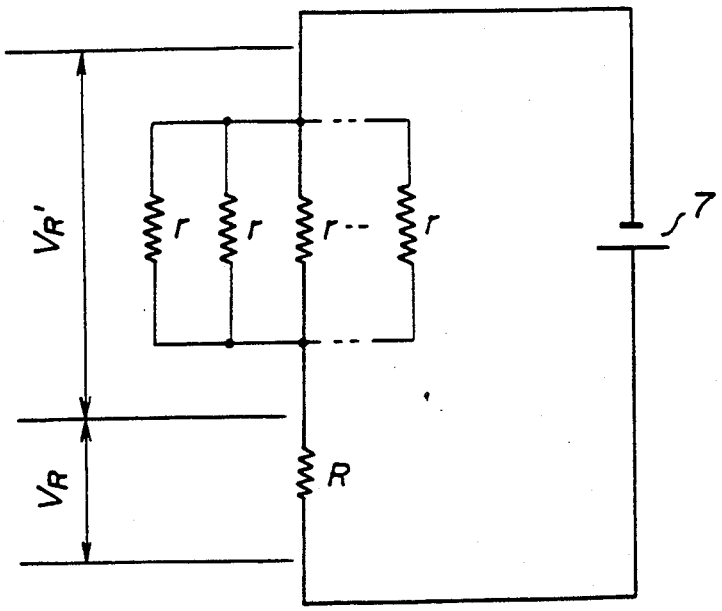
FIG. 3 PRIOR ART
FIG. 3 is a circuit diagram illustrating an equivalent circuit substantially representing a system including a resistance layer, recording electrodes, a common electrode and a power supply.
Figure 2:
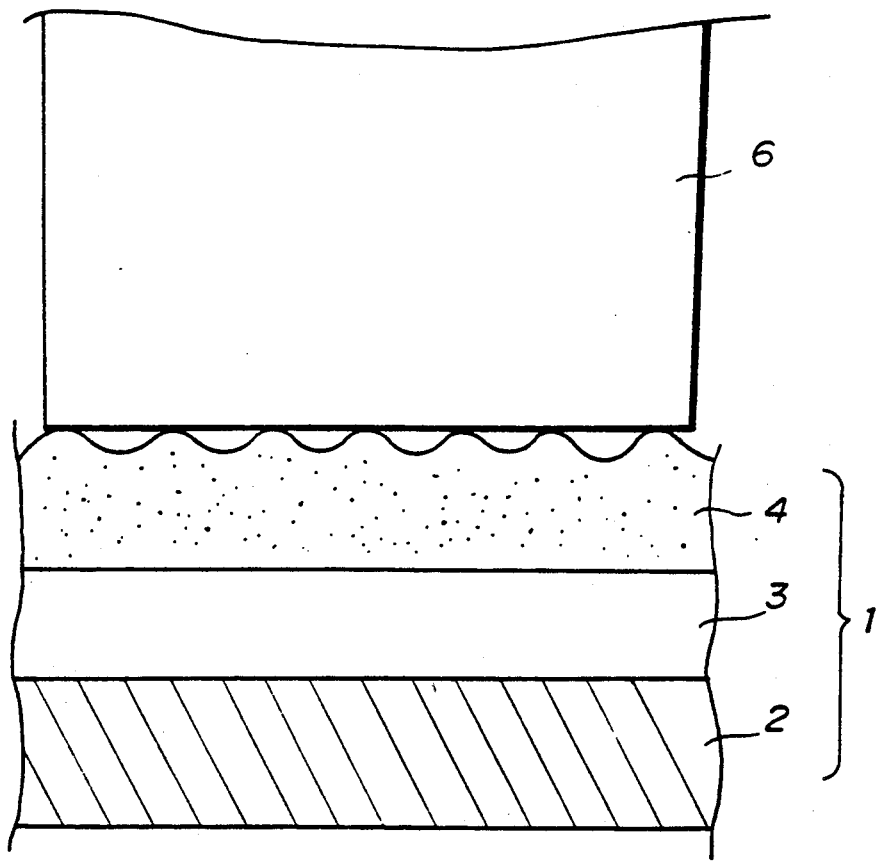
FIG. 2 PRIOR ART
FIG. 2 is an enlarged cross sectional view showing a portion at which a common electrode is in contact with a resistance layer.
Figure 4:
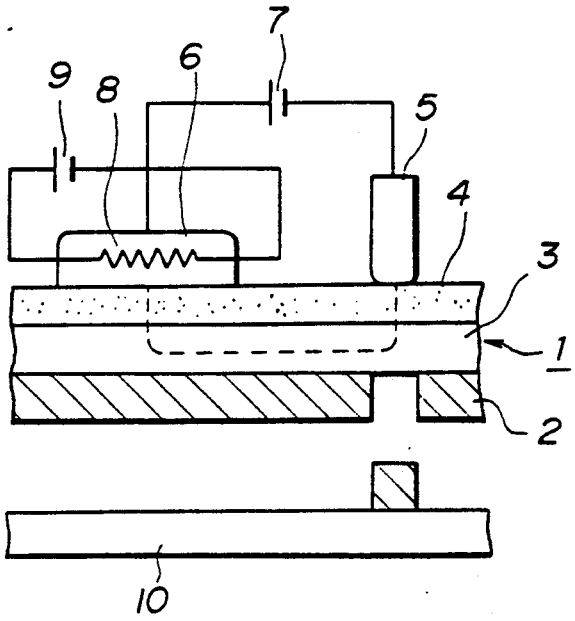
FIG. 4 is a cross sectional view showing a principle of a current-sensitized transfer type printer of the invention.

FIG.4 shows a basic structure of a current-sensitized transfer type printer. In FIG.4, those parts which are the same as those shown in FIG.1 are given the same reference numbers.

Figure 5:
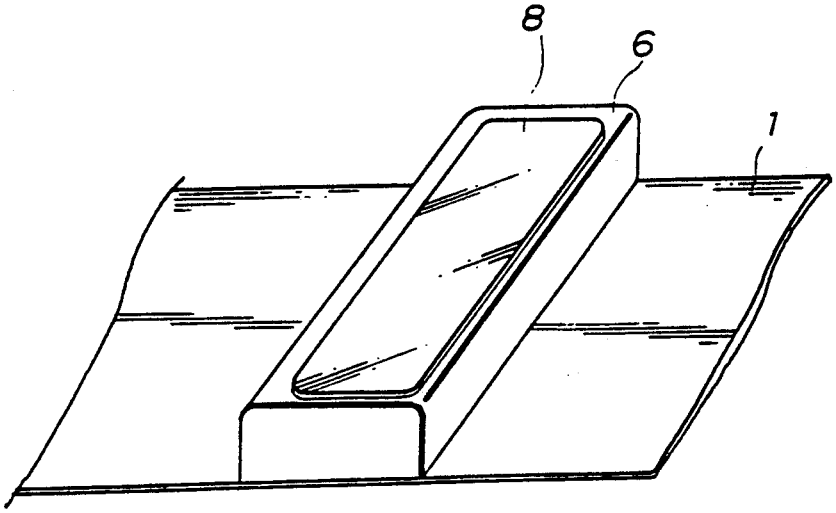
FIG. 5 is a perspective view showing an example of a provided on the common electrode.

Referring to FIG.4, the ink sheet 1 has the ink layer 2, the conductive layer 3 and the resistance layer 4. The ink layer 2 includes ink of the type which can be fused by heating or ink of the type which can be sublimated by heating. The conductive layer 3 is, for example, made of aluminium (A1). Carbon is compounded in a base film, for example, made of PET (polyethyleneterephthalate), so that the resistance layer 4 is made. Each recording electrode 5 and the common electrode 6 are provided so as to be in contact with the surface of the resistance layer 4 of the ink sheet 1. The power supply 7 is provided between each recording electrode 5 and the common electrode 6 so that the current can flow through the resistance layer 4 and the conductive layer 3 between the recording electrodes 5 which are selected in accordance with the printing signal and the common electrode 6, as shown by a dotted line in FIG.4. A heater 8 is provided on the common electrode 6. The heater 8 is, for example, a sheet type heater, and is adhered to the common electrode 6, as shown in FIG.5. A power supply 9 is connected to the heater 8 so as to supply a predetermined voltage to the heater 8.

Ink, in the ink layer 2, which is heated by supplying a current to each selected recording electrode 5, is fused or sublimated and transferred to the recording sheet 10.

Figure 6:
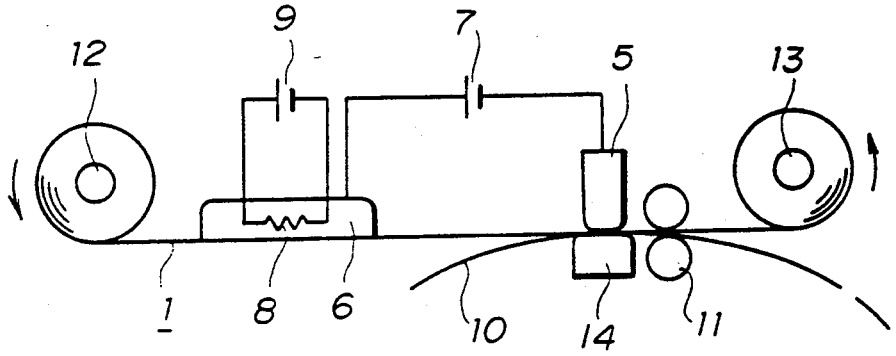
FIG. 6 a view of a current-sensitized transfer type printer according to an embodiment of the present invention.

Referring to FIG.6, which shows the current-sensitized transfer type printer, the ink sheet 1 is wound around a supplying roller 12 at an end thereof and around a winding roller 13 at another end thereof. The winding roller 13 is rotated by a motor (not shown) in a counterclockwise direction as shown by an arrow in FIG.6 so that the ink sheet 1 is fed from the supplying roller 12 to the winding roller 13. The recording sheet 10 and the ink sheet 1 are stacked on each other and put between each of the recording electrodes 5 and a platen 14. The recording sheet 10 and ink sheet 1 are sandwiched between feed rollers 11 provided close to the platen 14. The feed rollers 11 are rotated in a predetermined direction so that the recording sheet 10 and the ink sheet 1 are fed towards the winding roller 13 in a condition in which the recording sheet 10 and the ink sheet 1 do not slip on each other. The common electrode 6 is provided on an upstream side of the recording electrodes 5 with respect to a feeding direction of the ink sheet 1, and is in contact with the resistance layer 4 of the ink sheet 1. The heater 8 heats the common electrode 6 so that the ink sheet 1 positioned at the upstream side of the recording electrodes 5 is heated by the common electrode 6.

According to the above embodiment, the common electrode 6 is heated by the heater 8, so that a portion of the ink sheet 1, with which the common electrode 6 is in contact, is heated by the common electrode 6. In this case, the surface of the heated resistance layer 4 of the ink sheet 1 is softened, so that an area where the resistance layer 4 and the common electrode 6 are in contact with each other becomes large. Thus, the contact resistance between the resistance layer 4 and the common electrode 6 is small. Actually, due to the heating of the common electrode 6, the contact resistance between the resistance layer 4 and the common electrode 6 can be close to zero. In a state in which the area where the resistance layer 4 and the common electrode 6 are in contact with each other is large, as described above, even if the number of the selected recording electrodes 5 changes from the number of the same previously selected in accordance with the printing signal, the area where the resistance layer 4 and the common electrode 6 are in contact with each other hardly changes. In addition, as the contact resistance between the resistance layer 4 and the common electrode 6 is small, the drop voltage $V_R$ this contact resistance is also small. Therefore, even if the number of the selected recording electrodes 5 changes, the voltage $V_R'$ supplied to each selected recording electrode 5 hardly changes.

As a result of the above causes, even if the number of the selected recording electrodes 5 changes in accordance with the printing signal, the variation in the current supplied to each selected recording electrode 5 is very small. Thus, the amount of the ink, corresponding to each dot, fused or sublimated from the ink sheet 1 is substantially constant, and an image in which the density of each dot is stable is obtained.

Figure 7A:
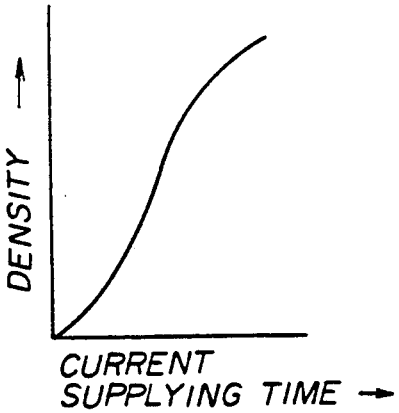
FIGS. 7A and 7B are graphs illustrating a characteristic of a recording density and a time for supplying the current.
Figure 7B:
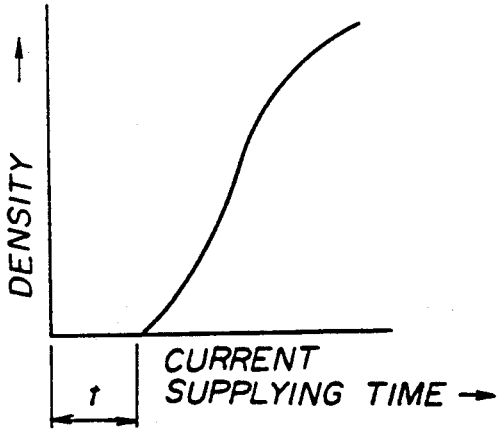

In addition, in the above embodiment, the common electrode 6 heated by the heater 8 is provided on an upstream side of the recording electrodes 5, so that the ink sheet 1 is pre-heated by the common electrode 6 before the recording electrodes 5 selectively heat it. That is, a time T (as shown in FIG.7B), which each selected recording electrode 5 pre-heats the ink sheet 1 for, is not required, so that the ink in the ink layer 2 starts to be fused or sublimated immediately after the current starts to be supplied to each selected recording electrode 5, as shown in FIG.7A. Therefore, a dot image can be rapidly printed on the recording sheet.

The temperature of the common electrode 6 is determined to be a predetermined value at which the ink in the ink layer 2 is not fused or sublimated. Thus, the voltage supplied from the power supply 9 to the heater 8 and the resistance of the heater 8 are respectively determined so that common electrode 6 is maintained at the above temperature at which the ink in the ink layer 2 is not fused or sublimated.

The present invention is not limited to the aforementioned embodiments, and variations and modifications may be made without departing from the scope of the claimed invention.

What is claimed is:

1. A current-sensitized transfer type printer comprising:

an ink sheet including an ink layer, a conductive layer and a resistance layer, said ink layer, conductive layer and resistance layer are stacked in order;

feeding means, coupled to said ink sheet, for feeding said ink sheet in a predetermined direction;

a plurality of recording electrodes, each of which is in contact with said resistance layer of said ink sheet;

a common electrode which is in contact with said resistance layer of said ink sheet;

power supply means, provided between each recording electrode and said common electrode, for supplying a current flowing between recording electrodes selected in accordance with image information and said common electrode, said current flowing through said resistance layer and said conductive layer existing between each selected recording electrode and said common electrode; and heater means, coupled to said common electrode, for heating said common electrode to cause said common electrode to pre-heat a part of said ink sheet which is in contact with said common electrode without thereby transferring the ink of the ink layer in said part of the ink sheet to the recording sheet, whereby ink of said ink layer is transferred to said recording sheet when it is heated by heat generated from said current flowing through said resistance layer.

2. A current-sensitized transfer printer as claimed in claim 1, wherein said common electrode is provided on an upstream side of said recording electrode with respect to said predetermined direction of said ink sheet.

3. A current-sensitized transfer type printer as claimed in claim 1, wherein said heater means includes a sheet shaped heater adhered to said common electrode and a power supply for supplying predetermined voltage to said sheet shaped heater.

4. A current-sensitized transfer type printer as claimed in claim 1, wherein said heater means heats said common electrode so that said common electrode is maintained at a certain temperature, said temperature having a value at which ink in said ink layer is not fused or sublimated and then not transferred to said recording sheet and said resistance layer is softened.

* * * * *